US006491088B1

(12) United States Patent
Sucker et al.

(10) Patent No.: US 6,491,088 B1
(45) Date of Patent: Dec. 10, 2002

(54) METHOD AND DEVICE FOR CONTINUOUSLY CASTING THIN METAL STRIPS

(75) Inventors: Jürgen Sucker, Düsseldorf (DE); Romeo Capotosti, Narni (IT)

(73) Assignees: SMS Schloemann-Siemag Aktiengesellschaft, Düsseldorf (DE); ACCIAI Speciali Terni S.p.A., Terni (IT)

( * ) Notice: Subject to any disclaimer, the term of this patent is extended or adjusted under 35 U.S.C. 154(b) by 0 days.

(21) Appl. No.: 09/673,534

(22) PCT Filed: Apr. 14, 1999

(86) PCT No.: PCT/EP99/02487

§ 371 (c)(1),
(2), (4) Date: Mar. 23, 2001

(87) PCT Pub. No.: WO99/54072

PCT Pub. Date: Oct. 28, 1999

(30) Foreign Application Priority Data

Apr. 17, 1998 (DE) ..... 198 17 034

(51) Int. Cl.[7] ..... B22D 11/128

(52) U.S. Cl. ..... 164/454; 164/476; 164/484

(58) Field of Search ..... 164/476, 154.5, 164/154.8, 454, 452, 484

(56) References Cited

U.S. PATENT DOCUMENTS 4,056,140 A * 11/1977 Ives et al. ..... 164/454

FOREIGN PATENT DOCUMENTS

| | | |
|---|---|---|
| DE | 2747000 | 4/1978 |
| EP | 0350431 | 1/1990 |
| EP | 0539784 | 5/1993 |
| EP | 0603598 | 6/1994 |
| EP | 0625388 | 11/1994 |
| EP | 0776708 | 6/1997 |

* cited by examiner

*Primary Examiner*—Kuang Y. Lin
(74) *Attorney, Agent, or Firm*—Friedrich Kueffner

(57) ABSTRACT

A disadvantage of continuously casting thin metal strips in a continuous casting plant (1) wherein the casting strand (7) exits the mould (2) in a downward direction and is guided in a vertical strand guide (3) with the help of pairs of driver rolls (4, 5) for supporting and conveying the strand (7), is that the force with which the driver rolls (4, 5) are pressed against the strand (7) results in the unchecked rolling of the strand while it is still soft. The aim of the invention is to solve this problem. To that end, the driver rolls (4, 5) are pressed against the strand (7) with a variable pressure ($P_1$, $P_2$) which is regulated "on-line" in accordance with the thickness ($d_3$, $d_4$) of the strand (7), in such a way as to obtain and maintain a constant strand thickness.

4 Claims, 2 Drawing Sheets

METHOD AND DEVICE FOR CONTINUOUSLY CASTING THIN METAL STRIPS

BACKGROUND OF THE INVENTION

1. Field of the Invention

The invention relates to a method and a device for continuously casting thin metal strips in a continuous casting device with an oscillating, water-cooled casting mold, a vertical strip guide arranged underneath it with devices for supporting and cooling the strand up to the point of solidification, one or more driver roll pairs which are pressed against the strand for supporting and conveying the strand, a device for bending the strand, and a device for bending the strand back.

2. Description of the Related Art

In the known prior art for continuously casting metal strips of minimal thickness (up to approximately 80 mm), the minimal strand thickness is achieved by a special shaping of the continuous cast plates and/or by squeezing the strand while the core is still liquid. Such a continuous casting device, as can also be taken from the company brochure "CSP/Compact Strip Production/Das neue Gieβ- und Walzverfahren fur die wirtschaftliche Bandherstellung" (The new casting and rolling method for economical strip manufacture), No. W4+9/319/company SMS Schloemann-Siemag Aktiengesellschaft/4000/8/87, is comprised typically of an oscillating casting mold, a vertical strand guide arranged underneath thereof and provided with water jets for cooling the strand to the point of complete solidification, and one or more driven roll pairs for conveying the strand out. In order for the casting device to be able to transport the strand out, the driver rolls are pressed with a certain pressure against the strand which prevents their slipping. A special feature of these continuous casting devices is the arrangement of the driver rolls for conveying the strand below the point of complete solidification wherein The absence of the liquid core in the strand ensures that the strand will not yield to the driver roll pressure and a sufficiently large tension force is produced on the strand.

In this connection, it is known to press the driver rolls with hydraulic cylinders against the strand wherein the pressure during the casting process is invariable. This solution has been successfully employed for casting low-carbon and austenitic stainless steel. However, when casting steels which are very soft at the temperature of 1100° C. , such as, for example, Si-alloyed steels, stainless ferritic steels, high carbon-contents steels, the pressure of the rolls for generating the Conveying force results; in a thickness reduction of the strand. Moreover, the required advancing pressure of the driver rolls in practice is adjusted substantially higher than would actually be sufficient in order to exclude with certainty the risk of slipping of the driver rolls, which is identical to the standstill of the strand. With this increased pressure, the strand is actually rolled in an uncontrolled fashion by means of the driver rolls with a thickness reduction of, for example, up to 8 mm for a 60 mm strand thickness.

Since the strength of the strand continuously and constantly changes as a function of all casting parameters which affect the strand temperature (e.g., parameters such as temperature of the melt, casting speed, intensity of secondary cooling), the thickness reduction of the strand is a variable parameter that cannot be influenced in the case of an invariable driver roll pressure. For controlling the forces which are exerted by the oppositely arranged guide rolls of a strand casting machine onto a strand passing therebetween, it is proposed according to DE 27 47 000 A1 to measure these forces and, in the case of deviations from a standard value, to readjust the size of the roll gap by a simple rotation of a nut or of a bolt. Such a readjustment or correction can be carried out quickly between individual casting runs. However, during the casting runs, the disadvantage of an uncontrolled rolling action remains.

The disadvantages of the uncontrolled and variable rolling of the strand by driver rolls are as follows:

splitting of the edges of the strand irregular thickness reduction of the strand difficulties in regard to the synchronization of the motor drives of the strand casting device because of the unknown length change of the strand difficulties in regard to maintaining the preset coil weight.

In order to avoid the undesirable uncontrolled rolling of the strand by the driver rolls, the roll pressure cannot surpass a certain limit.

The required conveying force can be achieved by increasing the number of roll pairs, by increasing the roll diameter, and by driving all rolls.

The disadvantages of all these measures are increased investment costs for the device technology and the additional production cost resulting from the increased service expenditure. The smaller the strand thickness, the greater the aforementioned disadvantages, because the strand weight, which supports the conveying force, is correspondingly smaller as a result of the reduced cross-section and, additionally, the shorter device height.

SUMMARY OF THE INVENTION

It is an object of the invention to develop a continuous cast device as well as a method for continuously casting thin metal strips with which the driver rolls for conveying the strand cause a predetermined thickness reduction of the strand with greatest possible constancy and maintain it during the entire casting process by means of a device-technological expenditure as minimal as possible.

The above object is inventively solved for a method of continuously casting thin metal strips in a casting device comprising an oscillating, water-cooled casting mold and a vertical strand guide positioned underneath it in that, for a defined thickness reduction of the strand of at least 2%, relative to the strand thickness at the point of complete solidification of the strand, and for maintaining constant a previously adjusted nominal strand thickness, at least one driver roll pair is pressed against the strand continuously during the entire casting process with a variable, defined pressure.

Advantageous embodiments of the invention are provided in the dependent claims wherein the aforementioned object is solved with respect to the device with at least one driver roll pair arranged below the point of complete solidification of the strand, which is connected to means for detecting the driver roll gap width and to means for generating and transmitting a variable pressure of the drive roll pair onto the strand.

When casting thin strands of soft steels, it is unavoidable that a rolling of the completely solidified strand occurs between the driver roll pairs when the number of driven driver roll pairs with large diameter is not to be increased and a standstill of the strand is to be avoided with certainty. Accordingly, in accordance with the method of the invention this rolling is carried out in a controlled fashion with a total strand thickness reduction, which is at least 2%. In this context, the thickness reduction of at least 2% is so great that the slipping of the driven rolls is prevented; it can be so great that the advantages of an increased strand thickness do have an effect in the area of the casting mold and the secondary cooling.

According to the invention, this controlled thickness reduction of the strand by means of at least one driver roll pair, while simultaneously keeping a previously adjusted nominal strand thickness constant, is achieved in that at least one driver roll pair conveying the strand out is pressed with a variable defined pressure continuously against the strand directly after its complete solidification. Accordingly, the actual roll spacing which corresponds to the strand thickness is continuously measured and is compared in a measuring and control device with the previously adjusted nominal strand thickness. Based on the measuring data comparison, the pressure with which the driver roll pair is pressed against the strand is controlled online by means of a hydraulic pump which is connected with the measuring and control device such that at all times the predetermined nominal strand thickness is obtained and maintained.

In an alternative embodiment of the invention, the driver roll pairs which convey the strand out are pressed with a variable pressure against position-adjustable abutments. Depending on the desired nominal strand thickness, the position-adjustable abutments are moved into corresponding positions so that a constant roll spacing corresponding to the nominal strand thickness results. The pressure acting against the abutments is at least so great that the roll spacing remains unchanged during the normal casting operation and that it is ensured that the roll pairs can be opened when the cold strand passes through or when casting disturbances occur.

Since during the casting operation the roll resistance, during rolling to the required minimum thickness reduction of 2% can change, it is required to exert the pressure in a variable manner onto the abutments in accordance with the predetermined thickness reduction in order to make possible an opening of the roll pairs for disturbances.

According to the invention, the discussed alternative possibilities cannot only be applied individually but can also be combined with one another. For example, it is possible to form a continuous casting device witty at least two driver roll pairs wherein the width of one driver roll pair can be controlled online with a variable pressure while the width of the other driver roll pair remains unchanged by the pressure which acts against an abutment. For a combination of these two alternatives, the total thickness reduction according to the invention is also at least 2%.

By means of the directed thickness reduction, i.e., a controlled rolling of the strand already by means of the driver rolls, a new concept of thin slab technology results wherein, in contrast to known methods (CPR, LCR ISP), the rolling of the strand is already carried out by means of the driver rolls directly after its complete solidification. This is achieved without special technological expenditure and, in contrast to the aforementioned known methods, does not reduce the casting output.

The rolling of the completely solidified strand, independent of which steel is being used, makes it possible furthermore to increase, without reduction of the casting output, the strand thickness in the area of the casting mold so that known improvements of the steel quality result. With the controlled rolling by means of the driver rolls it is also possible to produce thin strands which can be wound up without impairing their quality, thus resulting in new advantageous device concepts.

The strand casting device according to the invention is comprised of: a vertical strand guide positioned below the oscillating casting mold with devices for supporting and cooling and optionally squeezing the strand up to the point of its complete solidification; with at least one driver roll pair which is pressed against the strand for supporting and conveying the strand; a device for bending the strand; and a device for bending back the strand. At least one driver roll pair is connected directly below the point of complete solidification of the strand with means for producing a variable pressure, These means, which may be, for example, piston-cylinder units supplied by a hydraulic pump, are connected to a measuring and control device. The measuring and control device measures continuously by means of a measuring sensor, for example, an inductive travel sensor, the actual strand thickness between the driver roll pair, compares this measured value with a previously adjusted nominal value, and controls online, in the case of deviations from this nominal value, the pressure to be applied by the corresponding piston-cylinder unit.

In an alternative continuous casting device according to the invention, position-adjustable abutments are provided at least one driver roll pair against which the pressing means, for example, piston-cylinder units, are pressed with a variable pressure. The position-adjustable abutments are formed in this connection such that the roll spacing cannot fall below a previously adjusted value, while surpassing of the desired rolls spacing is prevented by the pressure and is possible only when the cold strand passes through and during casting disturbances.

BRIEF DESCRIPTION OF THE DRAWINGS

Further details, features, and advantages of the invention will be explained in more detail in the following with the aid of two embodiments illustrated schematically in the drawings. It is shown in.

DESCRIPTION OF PREFERRED EMBODIMENTS

Figure 1:
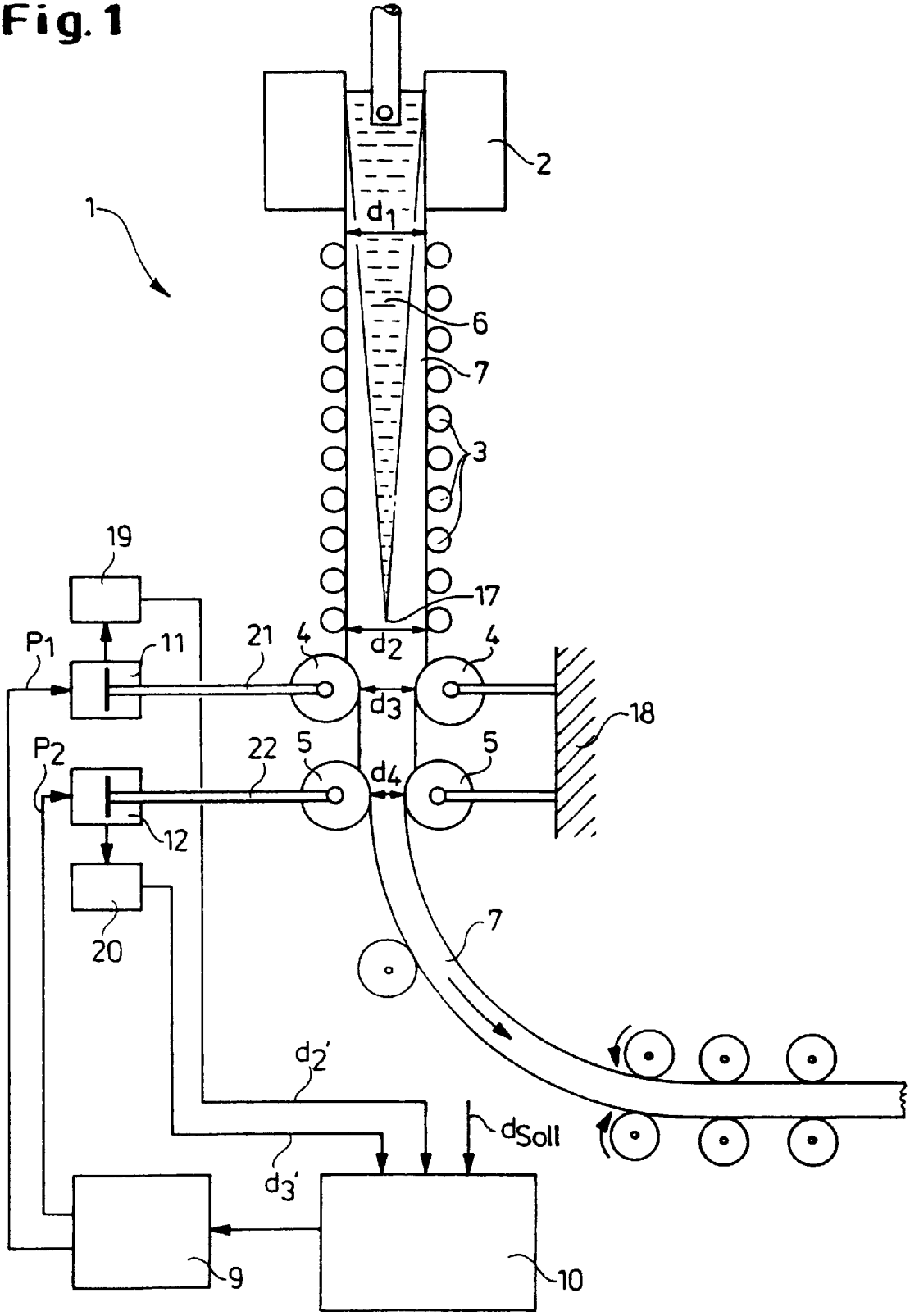
FIG. 1 a flow schematic of a part of a continuous casting device with online control of the driver roll pressure.

The part of the continuous casting device (1) illustrated in FIG. 1 is comprised of an oscillating casting mold (2) from which the casting strand (7) of a thickness ($d_{80}$) exits vertically in a downward direction. Underneath, a vertical strand guide (3) with devices for supporting and cooling and optionally for squeezing the strand (7) to the thickness (d2) are provided.

As is known, the casting strand (7), which is initially liquid, solidifies from the exterior to the interior on its path in the downward direction by means of a forced cooling in the area of the vertical strand guide (3), wherein the liquid core (6) becomes smaller and smaller and at the complete solidification point (17) of the strand is solidified across its entire cross-section. As a result of the complete solidification point (17) still having a very high strand temperature, the strand (7) is still very soft so that in this strand area the controlled rolling of the strand by means of the driver roll pair (4, 5) according to the invention can be employed.

For this purpose, in the embodiment according to FIG. 1 directly below the complete solidification point (17) two driver roll pairs (4, 5) are arranged below one another. With these two driver roll pairs (4, 5) the strand (7) is not only supported and conveyed in the downward direction but also rolled in a controlled fashion. The rolling action is carried out, starting at the initial strand thickness (d2), first by means of the driver roll pairs (4) with the pressure ($p_1$) to the strand thickness (d3) and then by the next driver roll pair (5) with the pressure (P2) to the strand thickness (d4) which is to correspond to the desired nominal strand thickness ($d_{nominal}$). The strand thickness reduction to be achieved by this controlled rolling should be at least 2% relative to the initial strand thickness (d2). In order to fulfill the two requirements of a minimum strand thickness reduction and the constancy of the strand thickness (d4) to the nominal strand thickness. the ($d_{nominal}$), strand thicknesses (d3) and (d4) are continuously measured online during the entire casting process and accordingly controlled when deviations occur. This is carried out as follows:

Each driver roll of the driver roll pair (4, 5) is pressed with a piston rod (21, 22) of a piston-cylinder unit (11, 12) with the pressure (P1, P2) against the strand (7) while the oppositely positioned driver roll is supported on the construction part (18). The position of the piston rods (21, 22), which represents a measure for the spacing of the two driver rolls from one another for a respective driver roll pair (4, 5), is represented by an electrical signal (d3', d4') by means of a suitable measured value sensor (19, 20), for example, an inductive travel sensor, and this signal (d3', d4') is continuously supplied to a measuring and control device (10). All measured data of the driver roll pair (4, 5) participating in the rolling action are entered into this measuring and control device (10), and the total thickness reduction of the strand (7) is compared with the predetermined nominal strand thickness ($d_{nominal}$). As a result of this comparison the measuring and control device (10) controls by corresponding control signals, which are supplied to the hydraulic pump (9), the required, possibly different, pressure (P1, P2) for the piston-cylinder units (11/12) of the driver roll pair (4, 5). Accordingly, any minimal change of the driver roll gap width is immediately measured and controlled by the measuring and control device (10) via the piston-cylinder unit (11, 12) and its measured value sensor (19, 20) and is transformed by it continuously into a corresponding change of the pressure (P1, P2) for the driver roll pair (4, 5) in question.

Figure 2:
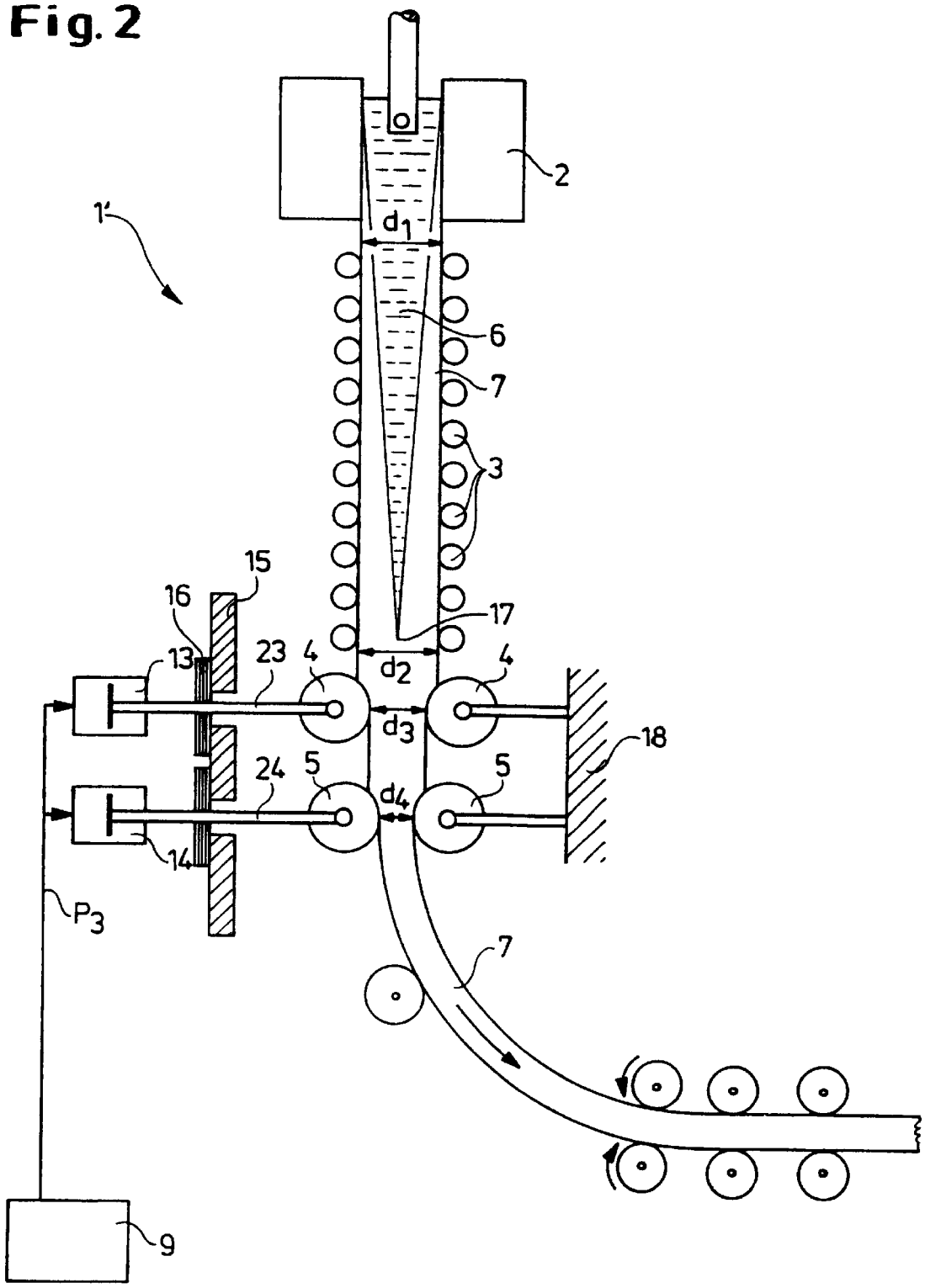
FIG. 2 a flow schematic of a part of a continuous casting device with two driver roll pairs fixedly advanced on the strand.

In FIG. 2, a further embodiment of the invention is illustrated herein the driver roll pair (4, 5) of the strand casting device (1') in this example is also pressed by a piston-cylinder unit (13, 14) against the completely solidified strand (7), however, with the difference that the pressure (P3) acts additionally via projections (16) provided on the piston rods (23, 24) of the piston cylinder units (13, 14) against position-variable stops (15). The driver roll gap width (d3 ,d4) defined by the stops can therefore no longer be smaller because this is prevented by the stops (15).

Surpassing of the predetermined drive roll gap width (d3, d4) is prevented in a simple way in that the pressure (P3) is selected to be higher than required for conveying the strand out. However, this increased pressure (P3), which is so high that during the normal casting operation the driver roll gap width (d3, d4) remains unchanged, does not result in an uncontrolled rolling of the strand, as is the case in the known continuous casting devices, but has no negative effect since it is directed against a stationary stop (15). Since the pressure (P3), on the other hand, should not be excessively high, so that at anytime, for example, during disturbances of the continuous casting operation, the driver rolls (4, 5) can be moved apart, the pressure (P3) is also variable and adjustable by means of the pump (9). In order to be able to roll in a controlled fashion different strand thicknesses in the same strand casting device (1'), the stops (15) are formed so as to be position-variable in order to be able to adjust in this way any desired driver roll gap width.

The invention is not limited to the embodiments illustrated in the drawings. or example, more than only two driver roll pairs for performing the rolling action according to the invention can be used directly down stream of the point of complete solidification of the strand, wherein also combinations of the two aforementioned possibilities:

the online control of the driver roll width and the fixation of the driver roll width by pressure limitation by means of stops are possible.

What is claimed is:

1. A method for continuously casting thin metal strips in a continuous casting device (1, 1') comprising an oscillating, water-cooled casting mold (2), the method comprising the steps of:

supporting and cooling and optionally squeezing a strand coming from the casting mold in a vertical strand guide (3) arranged underneath the casting mold up to a point of complete solidification (17); and pressing two driver roll pairs (4, 5), provided for conveying the strand (7) out of the continuous casting device, continuously against the strand (7) during the entire casting process with a variable, defined pressure (P1, P2) directly after the point of complete solidification for achieving a defined thickness reduction of the strand (7) of at least 2% relative to the strand thickness (d2) at the point of complete solidification (17) and for keeping constant a nominal strand thickness ($d_{nominal}$).

2. The method according to claim 1, further comprising the steps of:

determining produced actual strand thicknesses (d3, d4) and entering the produced actual strand thicknesses (d3, d4) continuously as control parameters into a measuring and control device (10) connected to a hydraulic pump (9);

comparing the produced actual strand thickness with a pre-adjusted nominal strand thickness ($d_{nominal}$);

continuously controlling online the generated variable pressure (P1, P2) of the two driver roll pairs (4, 5) produced by the hydraulic pump (9) via hydraulic piston-cylinder units (11, 12) based on the results of the step of comparing.

3. The method according to claim 1, further comprising the step of advancing the two driver roll pairs (4, 5) toward the strand (7) by mechanical or hydraulic means with a variable pressure to such an extent that the driver roll gap width ($d_3$, $d_4$) is kept constant and the total strand thickness reduction is at least 2%.

4. The method according to claim 1, further comprising the steps of pressing one of the two driver roll pairs (4, 5) with a variable pressure ($P_1$, $P_2$) against the strand (7) and keeping the driver roll gap width of another of the roll pairs constant, wherein the total strand thickness reduction after passing through all roll pairs (4, 5) is at least 2%.

* * * * *